United States Patent [19]

Donan, Jr.

[11] 4,300,859

[45] Nov. 17, 1981

[54] DUAL DIAMETER BUSHING/SEAL FOR MINE ROOF BOLT

[75] Inventor: David C. Donan, Jr., Manitou, Ky.

[73] Assignee: Waiamea Company, Inc., Manitou, Ky.

[21] Appl. No.: 192,061

[22] Filed: Sep. 29, 1980

[51] Int. Cl.[3] ..... E21D 20/00; E21D 21/00

[52] U.S. Cl. ..... 405/259; 277/208

[58] Field of Search ..... 405/259–261, 405/262; 277/208; 411/15–24, 28–34

[56] References Cited

U.S. PATENT DOCUMENTS

| | | | |
|---|---|---|---|
| 2,952,129 | 9/1960 | Dempsey | 405/261 |
| 3,057,408 | 10/1962 | Griffitts | 277/208 |
| 3,212,269 | 10/1965 | Olsen | 405/260 |
| 3,247,905 | 4/1966 | Baker | 277/208 X |
| 3,487,753 | 1/1970 | Read et al. | 277/208 X |
| 3,504,498 | 4/1970 | Triplett | 405/259 X |
| 4,103,498 | 8/1978 | Steinborn et al. | 405/259 X |

FOREIGN PATENT DOCUMENTS

| | | | |
|---|---|---|---|
| 2749068 | 5/1979 | Fed. Rep. of Germany | 405/261 |
| 569650 | 11/1957 | Italy | 277/208 |
| 89536 | 11/1958 | Netherlands | 277/208 |
| 2004967 | 4/1979 | United Kingdom | 405/260 |

*Primary Examiner*—Dennis L. Taylor

*Attorney, Agent, or Firm*—Cahill, Sutton & Thomas

[57] ABSTRACT

A bushing/seal assembly for providing an airtight seal between the shaft of a mine roof bolt and a roof bolt hole includes a body having first and second flexible skirts extending outwardly from the body, the diameter of the first skirt being less than the diameter of the second skirt in order to facilitate adequate sealing with both standard size and slightly overside roof bolt holes. A rigid stabilizing washer engages the flexible body, the roof bolt shaft and the wall of the roof bolt hole in order to prevent excessive tilting of the roof bolt assembly after anchoring thereof in the roof bolt hole.

14 Claims, 13 Drawing Figures

DUAL DIAMETER BUSHING/SEAL FOR MINE ROOF BOLT

BACKGROUND OF THE INVENTION

1. Field of the Invention

The invention relates to mine roof bolt assemblies and more particularly, to washers, bushings, gaskets and the like for sealing the interiors of mine roof bolt holes from ambient air present in mine shafts.

2. Description of the Prior Art

It has been found that certain layers of mine roof strata having a sufficient content of water absorbent clays such as montmorillonites, illites, etc., are very vulnerable to reaction with humid mine air. It has also been found that layers of roof strata containing certain minerals such as pyrite, calcite, etc. react adversely with either oxygen or a combination of moisture and oxygen and become greatly weakened by such reaction. If the roof bolt hole is not reliably sealed from the mine atmosphere, the roof bolt hole exposes the above-mentioned kinds of layers in the roof strata to a continually replenished supply of oxygen and/or water vapor, as subsequently explained. A vapor phase transfer reaction occurs wherein the moisture of the air with the above-mentioned water absorbent clays, or the reaction of the oxygen with the above-mentioned pyrites, calcites, etc., causes the corresponding layers of upper strata to weaken or oxidize. It has been found that as long as the supply of moist air and oxygen is replenished, the deterioration of the above kinds of layers extends laterally, eventually severely degrading the strength of the "laminated" mine roof strata configuration by causing lateral "slippage" between layers on either side of the degraded layer. The load bearing characteristics of such roof strata are believed to be greatly weakened even though the mine roof bolts remain tightly anchored in the upper strata. Diurnal barometric pressure changes, seasonal atmospheric pressure changes, pressure variations caused by pulsations of mine ventilation systems, variation in pressure caused by shooting and blasting, and variations in pressure due to extending and closing of working areas to mine ventilation all cause pressure changes in the ambient mine atmosphere which causes a "breathing" type of air exchange between the interior of roof bolt holes and the outside mine atmosphere if the roof bolt assemblies do not provide airtight sealing between the interior of the roof bolt hole and the mine.

Many of the known roof bolt assemblies do not provide reliable airtight sealing to prevent the above-mentioned "breathing," thus leaving the various above-mentioned strata exposed within the roof bolt holes and vulnerable to the above-described degradation due to the action of moisture and oxygen "inhaled" by the roof bolt holes. Therefore, a more detailed description of the action of the roof shales which are vulnerable to moisture is appropriate.

It has been found that shales are of sedimentary origin and composed of a mixture of fine grained sediments deposited in a layered type formation. The shales consist of hardened clays and silts possessing cleavage parallel to bedding. After deposition of the sediments the change from clay to shale is attended by a greater or less degree of recrystallization of the constituents and usually some enlargement of the particles. Many shales include a percentage of water absorbing clays such as the montmorillonite (smectite) group and to a lesser degree the illites, hallosites, etc., of the clay family of minerals. The clays may be finely dispersed throughout the shale formation or they may be deposited in very thin layers within the formation. The clay may vary in the concentration and location both vertically and laterally within the shale formation. A general observation of the shale roof strata of coal seams in the Midwest is that several inches of roof strata immediately above the coal, usually consisting of a dark siltstone (miner's slate) is more impervious to moisture than the upper portions of the immediate mine roof shale. The color of the roof shale is not a reliable indicator of the presence or absence of water absorbing clays.

The clays are very fine grained sedimentary deposits and generally consist of hydrated silicates of aluminum with various impurities. The water absorbent clays such as the montmorillonites, upon absorbing water, expand in volume and become plastic, which destroys their ability to resist stresses of both compression and tension. These clays have a high cation exchange capacity as compared to the less absorbent clays, they also have a flat pate-like crystalline structure. It is the interlayer water between the unit silicate layers of these minerals that causes their swelling and expanding characteristics. One important characteristic of the montmorillonites is that they absorb water up to a given point where equilibrium is reached, however, if allowed to dry, even a small amount, they will slake and swell immediately if again exposed to water. For this reason, it is important that bolt holes be sealed promptly against the drying of inherent and stabilized moisture of the clay and the reintroduction of moisture from the air. Clays that are water absorbent may expand as much as 1200% of their volume, and when confined, exert pressures in excess of 14,000 p.s.i.

Surface air taken into the mine contains moisture in the form of water vapor (gaseous state of water). The relative humidity of the air is measured as the ratio of the amount of water vapor actually present to the greatest amount possible at a given temperature. The total amount of vapor possible in the air varies with the temperature, the higher the temperature, the greater the capacity for holding vapor in the air. On a very humid day, the vapor content may be as much as 7% or more of the air. Water vapor expands in air space completely, equalizing the humidity of air within a bolt hole with the humidity of the air within the mine workings (Dalton's law of partial pressures and the kinetic molecular theory). Since the transfer of water from air to the clay in the shale takes place in a vapor phase transfer, restrictions to the entrance of mine air into a bolt hole can affect the volume and rate of vapor transfer into the bolt hole, and in turn, the time period involved in the clay-water reaction. The humidity of the air is constantly changing, during the day, in cycles, from day to day, and seasonal changes, the summer months being more humid than the winter months in the Central and Eastern United States.

A variety of mine roof bolt assemblies are known in the art. They usually include a bolt of from three to six feet in length, a roof plate or support plate through which the roof bolt extends, and an expansion shell threaded onto a threaded end of the roof bolt. A mine roof bolt hole is drilled, usually perpendicularly to the surface of the mine roof, with the expansion shell inserted into the roof bolt hole such that the support plate abuts the mine roof. The roof bolt is tightened, causing the expansion shell to expand, thereby anchoring the entire assembly into the mine roof strata and forcing the support plate inwardly against the mine roof. The mine roof strata described above is composed of various layers of different types of rock having varying strength characteristics. A plurality of spaced mine roof bolts installed in the mine roof tends to secure the various layers of mine roof strata together to prevent "slippage" therebetween, increasing the strength of the laminated strata, thereby preventing caving of the mine roof. However, up to now, the known mine roof bolt assemblies have not satisfactorily supported mine roofs wherein mine roof strata exposed by the roof bolt holes to ambient mine air and moisture has caused certain kinds of mine roof strata to weaken. Mine roof bolt assemblies are known to fall out of degraded roof bolt holes, eliminating the strata layer binding needed to prevent slippage between different layers of mine roof strata. It is also known that in certain cases, a mine roof may collapse even though all of the mine roof bolts therein are sufficiently tightly anchored in a hard layer, such as limestone.

This may be due to the fact that when a roof bolt hole is drilled into a shale roof it exposes the interior of the hole to mine air. Mechanical expansion shell-type bolt assemblies are not designed to provide airtight sealing of the bolt hole. When the roof bolt assembly is tightened in the hole, mine air can enter the hole, through the opening in the base plate and around the shank of the bolt and over the top of the base plate, particularly when the bolt is not installed perpendicular to the roof surface, or when the exposed roof surface is uneven. Vapor from humid mine air enters the bolt hole and comes in contact with the exposed shale strata in the interior of the bolt hole. If the exposed strata contains water absorbent type clays, then the vapor will react with the clay causing a deterioration of the strata. It is my belief that the progressive deterioration of the vulnerable strata takes place in cycles, viz the clay reacts with the water vapor until it reaches its equilibrium point, then a decrease in humidity permits a partial drying of the affected clay, then upon the next increase in humidity, the clay rapidly absorbs water until it again reaches its equilibrium point. The expansion and contraction of the clay in cycles affords an opportunity to extend the perimeter of the interface zone between the changed (by water) crystalline structure of the clay and the undisturbed crystalline portion of the clay formation. These water-clay cycles may be frequent or extended depending upon the variation in the humidity of the air, and the distribution of the water absorbent clays exposed in the bolt hole. As the affected (disturbed) area of the clay works its way outward from the hole, the rate of extension initially is greatly retarded due to the exponential increase in the area involved.

In a mine roof where the bolt holes are not sealed airtight, the vulnerable shales exposed within the hole interact with vapor from the air, the clay expands and becomes plastic and the stress resistance of the disturbed formation is destroyed, this causes a shift in the stress load carried by the roof strata which may cause overstressing in other areas of the mine roof. The strata beneath the disturbed clay zone may fail, unless the rock resistance of the lower strata is sufficient to offset the lost support of the disturbed upper zone. If the affected area is in the area of contact between the expansion shell and the wall of the bolt hole, the plasticity of the affected clay will relieve the stress imposed on the bolt hole wall by the expansion shell and the shell will become loosened and ineffective. If the area affected is below the area of contact with the expansion shell, then the strata below the affected zone may fall away from the bolt leaving the bolt dangling in the remaining portion of the roof. Where the upper part of a roof fall coincides with the top or upper part of the bolt holes, it is indicative that the cause of the fall may be due to the interaction of the humid mine air with the clay of the strata intersected by the bolt holes.

Many roof falls in shale roof in bolted areas are unpredictable on account of the many variables involved, including (1) the amount and location of water absorbent clays present in the roof shales, (2) the type of clays present, (3) restrictions to the entrance of mine air into the bolt holes due to the configuration of the surface of the roof and the positioning of the bolt and base plate with respect to the hole opening, and (4) the relative humidity of the mine air, particularly the seasonal variations in humidity.

U.S. Pat. No. 2,829,502 describes a mine roof bolt assembly for excluding mine air from a mine roof bolt hole to prevent spalling or crumbling of the side walls of the interior of the roof bolt hole by use of a large conical stopper-like washer on the shaft of a particular type of roof bolt. U.S. Pat. No. 3,651,651 shows a stabilizing bushing and a flat washer. U.S. Pat. No. 3,521,454 illustrates a flexible annular washer which accommodates variations in the surface surrounding the mount of a rock bolt hole. U.S. Pat. Nos. 4,183,699 and 4,188,158 disclose seals which contact the mine roof at the mouth of a roof bolt hole. In some instances, irregularity of the material around a roof bolt hole prevents these seals from being completely effective. The state of the art in roof bolt assemblies is believed to be further indicated by U.S. Pat. Nos. 4,162,133; 3,528,253; 4,103,498; 4,147,458 and 3,238,731. Thus, none of the known rock bolt or roof bolt assemblies provide reliable sealing of the interior of the mine roof bolt hole from mine air in certain practical instances, including the one set forth below.

Mine roof bolt holes ordinarily are drilled to a closed hole diameter tolerance in order to provide effective anchoring by means of the above-mentioned anchor shell assembly of conventional roof bolt assemblies. In certain instances, the roof strata is softer at the base portion than in the upper part whereat the anchor shell is to engage the strata comprising the walls of the roof bolt hole. Where such soft strata at the base portion of the hole is encountered, the drill bit utilized for drilling a standard diameter roof bolt hole rapidly penetrates the soft strata, making an irregularly shaped hole having a corkscrew-like pattern. Such holes, drilled by standard diameter drill bits in soft strata, usually are somewhat undersized. Consequently, considerable difficulty is frequently experienced in inserting the anchor shell of a roof bolt assembly into the lower portions of such roof bolt holes. In order to overcome this difficulty, it is common practice to first drill the lower part of the roof bolt hole in the soft strata with a drill bit having a diameter that is slightly oversized, and then change to the standard diameter drill bit as firmer strata into which the anchor shell will be anchored is encountered. The upper portion of the roof bolt hole is then drilled utilizing the standard diameter drill bit.

Although the foregoing technique avoids the difficulty of inserting the anchor shell into the roof bolt hole, it complicates sealing of the roof bolt hole to the roof bolt shafts, which, as explained above, is necessary to prevent deterioration in the strata to which the roof bolt is anchored. The complication referred to is the presence of substantial numbers of both standard diameter and oversized diameter roof bolt holes, requiring the use of at least several diameter roof bolt seal assemblies to effect the necessary sealing of the lower portion of the roof bolt hole from ambient mine air.

Therefore, it is an object of the invention to provide a bushing/seal assembly for sealing a roof bolt and roof bolt hole, which bushing/seal assembly effectively seals a roof bolt hole having any diameter within a predetermined range.

Although roof bolts are ordinarily axially aligned with the roof bolt holes when the roof bolt assemblies are inserted therein, anchoring of the anchor shells frequently result in "tilting" of the tightened roof bolt shaft within the roof bolt hole, causing a lower portion thereof to be "offset" or off-center with respect to the axis of the roof bolt hole. This condition frequently causes difficulty in obtaining an airtight seal of the roof bolt hole.

Therefore, another object of the invention is to provide a bushing/seal assembly for a roof bolt which avoids a sufficient amount of tilting of the roof bolt shaft after anchoring of the roof bolt assembly to prevent destruction of a seal of the roof bolt hole by means of a seal assembly through which the roof bolt shaft extends.

SUMMARY OF THE INVENTION

Briefly described, and in accordance with one embodiment thereof, the invention provides a bushing/seal assembly for providing a sealing relationship with a roof bolt shaft and a roof bolt hole having a diameter within a predetermined range, the bushing/seal assembly including a flexible body having first and second flexible skirts, one flexible skirt having a diameter selected to form an airtight seal with a standard size roof bolt hole and a second flexible skirt having a diameter and resilience selected to form an airtight seal with an oversize roof bolt hole. In the described embodiment of the invention, a rigid, stabilizing washer element engages the flexible body of the bushing/seal assembly. A roof bolt shaft extends through the body of the bushing/seal assembly and an opening in the rigid stabilizing washer. The periphery of the stabilizing washer engages the walls of a roof bolt hole to prevent an amount of tilting of the roof bolt shaft which will significantly reduce the level of sealing of either the first or second flange with the wall of a roof bolt hole. In one embodiment of the invention, the stabilizing washer includes a flat rigid metal washer having a plurality of notches for receiving lugs which extend from an end of the flexible body against which the rigid stabilizing washer rests. In another embodiment of the invention, the stabilizing washer includes a cylindrical upper section and a cylindrical lower section, the diameter of the cylindrical upper section being substantially greater than the diameter of the cylindrical lower section. The upper portion of the body of the flexible bushing/seal includes a cylindrically shaped portion integral therewith having a cylindrical opening for snugly receiving the lower cylindrical portion of the stabilizing washer, the stabilizing washer having a hole which closely fits the roof bolt shaft, thereby preventing tilting of the stabilizing washer.

A variety of interior sphincter flanges are provided in several embodiments of the body of the flexible bushing/seal for providing an airtight relationship with the surface of the roof bolt shaft. In one embodiment of the invention, a metal spring clip disposed around the flexible body of the bushing/seal assembly clamps the interior wall of the bushing/seal body tightly against the outer surface of the roof bolt shaft to produce an airtight seal therewith.

DESCRIPTION OF THE INVENTION

Figure 1:
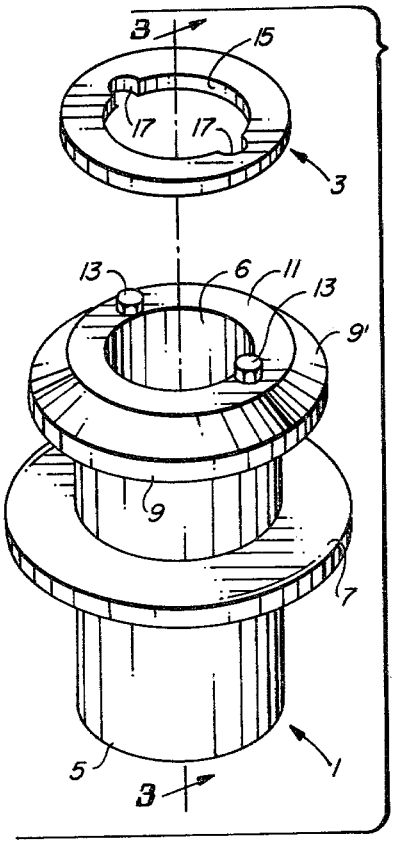
FIG. 1 is a perspective view of the bushing/seal assembly of the present invention.
Figure 2:
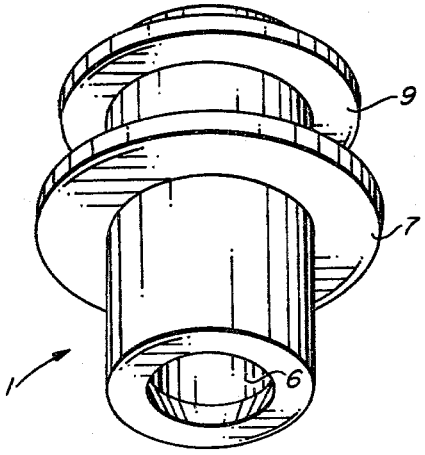
FIG. 2 is an alternate perspective view of the body of bushing/seal assembly of FIG. 1.
Figure 3:
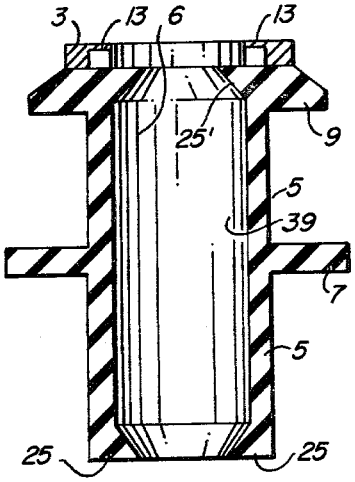
FIG. 3 is a sectional view taken along section line 3—3 of FIG. 1.

Referring now to FIGS. 1–5, bushing/seal assembly 1 includes a tubular body section 5 having a hollow interior 6. A stem of a conventional mine roof bolt shaft 23 passes through hollow interior 6, which snugly grips the stem surface. A sphincter, having a diameter less than a diameter of hollow interior 6, is disposed at the lower end of tubular body 5 for tightly gripping the stem or shaft of roof bolt 23 to provide an airtight seal therewith. An upper skirt 9 extends radially from the upper outer surface of tubular body 5. A lower skirt 7, which has a larger diameter than the diameter of upper skirt 9, extends radially from the outer surface of tubular body 5 and is based below upper skirt 9. Tubular body 5 and upper and lower skirts 9 and 7, which are integrally formed with tubular body 5, can preferably be composed of an elastomer, such as neoprene.

A flat upper surface of tubular body 5 is designated by reference numeral 11, and serves as a platform from which two lugs 13 extend upward. A steel stabilizing washer 3 having flat, parallel upper and lower surfaces has a pair of lug-receiving semicircular notches 17 therein for snugly receiving lugs 13.

Figure 5:
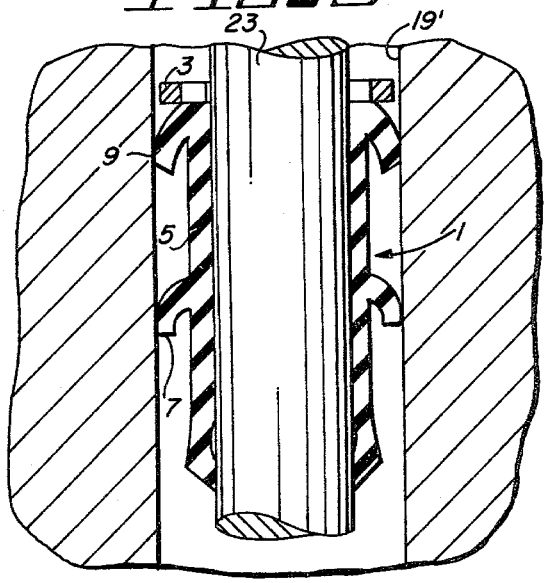
FIG. 5 is a partial sectional view illustrating the working of the bushing/seal assembly of FIG. 1 in a standard size mine roof bolt hole.
Figure 6:
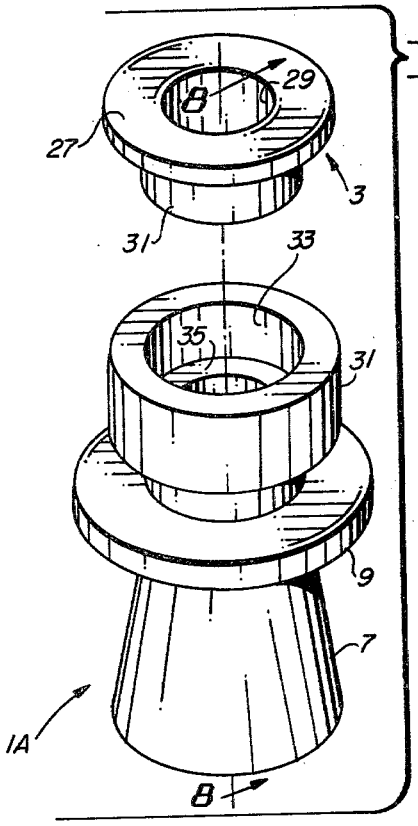
FIG. 6 is a perspective view of another embodiment of the invention.

As best seen in FIG. 5, bushing/seal 1, when disposed about the stem of a roof bolt 23 and positioned in a roof bolt hole 19' having a standard-sized diameter, provides an airtight seal with the walls of roof bolt hole 19' due to the outward pressure exerted by upper skirt 9 against the walls of roof bolt hole 19. The diameter of upper skirt 9 and the thickness and resiliency thereof are selected so that the outward pressure exerted by upper skirt 9 against the walls of roof bolt hole 19′ ensures an airtight seal therewith which prevents moist mine air from entering the portion of the roof bolt hole above bushing/seal assembly 1, even if roof bolt 23 is not perfectly centered in roof bolt hole 19′.

Figure 4:
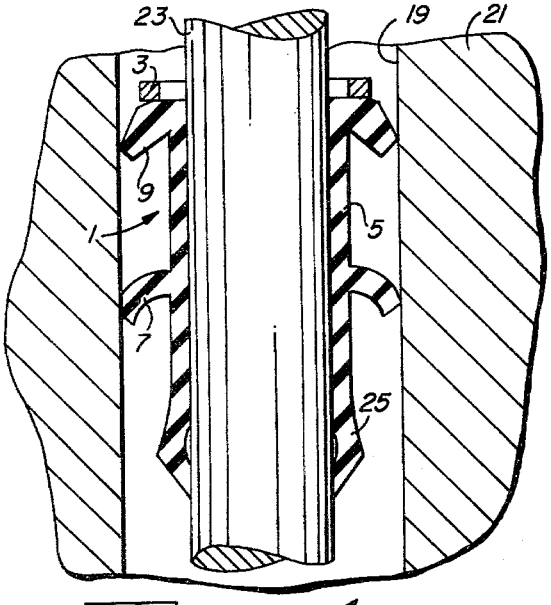
FIG. 4 is a partial sectional view illustrating the working of the bushing/seal assembly of FIG. 1 in an oversized side mine roof bolt hole.

Referring now to FIG. 4, if a slightly oversized roof bolt hole 19 is encountered, the same bushing/seal assembly 1 can be utilized to obtain the desired airtight seal. In this instance, larger diameter lower skirt 7 flexes outward to contact the walls of oversized roof bolt hole 19 providing an airtight seal therewith, despite the fact that upper skirt 9 may not make an airtight seal therewith, especially if roof bolt 23 is slightly off-center with respect to roof bolt hole 19.

Stabilizing washer 3, when oriented so that its plane is perpendicular so the axis of roof bolt 23 and is maintained in that position by platform 11 and lugs 13 of tubular body 5, prevents roof bolt 23 from deviating too far away from the center of either oversized roof bolt hole 19 or standard sized roof bolt hole 19′. (However, if stabilizing washer 3 were tilted, it would be possible for roof bolt 23 to be displaced further off-center than if stabilizing washer 3 is perpendicular to the axis of roof bolt 23).

It should be noted that the lower skirt 7 must have more flexibility than upper skirt 9, since lower skirt 7 must be compressed into the smaller diameter of standard roof bolt hole 19′, wherein upper skirt 9 is mainly relied upon to provide an airtight seal.

The spacing between upper skirt 9 and lower skirt 7 is selected so that when upper skirt 9 is fully flexed downward, it will not overlap any portion of lower skirt 7. It should be noted that tubular body 5 has a lower extension portion which extends a sufficient distance below lower skirt 7 that when the bushing/seal assembly 1 is forced into a roof bolt hole by a mine roof bolt support plate, both upper skirt 9 and lower skirt 7 will be forced a sufficient distance into the roof bolt hole to avoid minor irregularities in the wall of the roof bolt hole adjacent to the mouth thereof, which irregularities might prevent the lower skirt 7 from making firm contact with the complete inner circumference of the bolt hole, thereby preventing an airtight seal from being accomplished.

As mentioned above, unless stabilizing washer 3 is installed at substantially a right angle relative to roof bolt 23, stabilizing washer 3 becomes relatively ineffective in protecting the flexible bushing/seal from being crushed against one wall of a roof bolt hole (thereby preventing an airtight seal from being accomplished) if roof bolt 23 is forced to tilt as it is tightened to achieve anchoring thereof.

For use in conjunction with a conventional $\frac{5}{8}$ inch diameter roof bolt (which has a shaft diameter of 9/16 inch, the $\frac{5}{8}$ inch dimension referring to the threaded portion), the inside diameter of hollow interior 6 is preferably $\frac{5}{8}$ of an inch, and the outside diameter thereof is preferably $\frac{7}{8}$ inch. The outside diameter of upper skirt 9 is preferably 1 and $\frac{5}{8}$ inches and the maximum thickness thereof is one-fourth of an inch. A sloped surface 9′ on the upper surface of upper skirt 9 has an outside diameter of 1 and $\frac{1}{4}$ inches at its upper portion and an outside diameter of 1 and $\frac{5}{8}$ inches at its lower portion, the minimum thickness of upper skirt 9 being approximately one-eighths of an inch.

The height of each of sphincter portions 25 and 25′ of the embodiment of the invention shown in FIG. 1 is approximately one-fourth of an inch, the minimum inside diameter thereof being approximately $\frac{3}{8}$ of an inch.

The outside diameter of lower skirt 7 is one and $\frac{3}{4}$ inches, the thickness thereof being one eighth of an inch. The spacing between upper skirt 9 and lower skirt 7 is one-half inch, tubular body 5 extending $\frac{3}{4}$ of an inch below lower skirt 7.

The overall height of bushing/seal assembly 1 is preferably one and $\frac{3}{4}$ inches for the embodiment of the invention shown in FIGS. 1–5.

Figure 9:
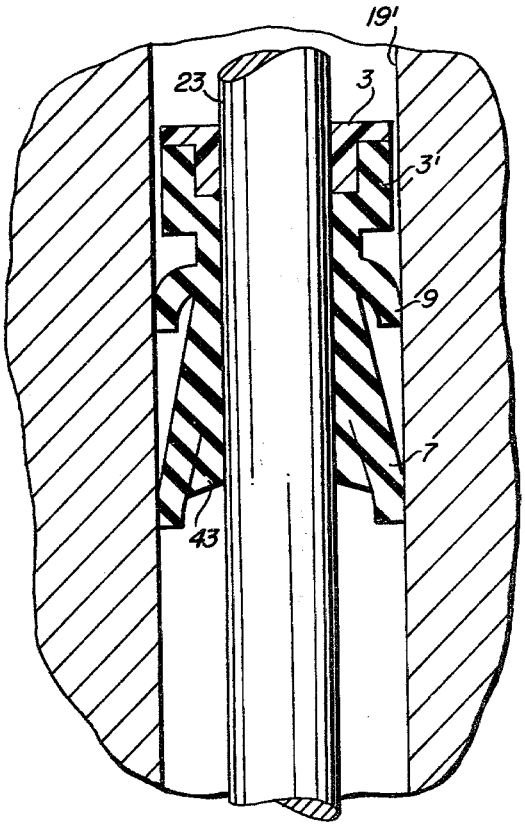
FIG. 9 is a partial sectional view useful in explaining the operation of the bushing/seal assembly of FIG. 6 in a standard size roof bolt hole.

Another embodiment of the invention is shown in FIGS. 6–9, this embodiment being different from the embodiment of FIG. 1 in that the lower portion of tubular body 5 flares outward, and lower skirt 7 extends or flares outward at the same slope. A lower sphincter 25 is provided at the lower end of tubular body 5. The illustrated arrangement provides for increased pressure applied to the outer circumferential portion of sphincter 25 by lower skirt 7 as lower skirt 7 is flexed inward by the walls of roof bolt hole 19′, as shown in FIG. 9. For this embodiment of the bushing/seal assembly, upper skirt 9 preferably has a greater diameter than lower skirt 7 for sealably engaging walls of an oversized roof bolt hole.

A different configuration of stabilizing washer 3 is shown in the arrangement of FIGS. 6–9, wherein stabilizing washer 3 has a flat, relatively shallow upper section 27 and a relatively longer lower "sleeve" section 31 having a substantially smaller diameter than upper section 27. Sleeve portion 31 fits within a mating recess 33 formed by an upper washer-receiving section 3′ disposed on the upper end of tubular body 5. The elongated sleeve section 31 prevents stabilizing washer 3 from tilting on the stem of roof bolt 23, thereby ensuring that roof bolt 23 will move no further from the center of the roof bolt hole than a distance equal to the difference between the radii of the roof bolt hole and the upper portion 27 of stabilizing washer 3. As in the embodiment of FIGS. 1–5, tubular body 5 and upper and lower skirts 9 and 7 and washer receiving section 3′ are all integrally formed of an elastomer, such as neoprene. As before, stabilizing washer 27 is preferably formed of steel.

Figure 10:
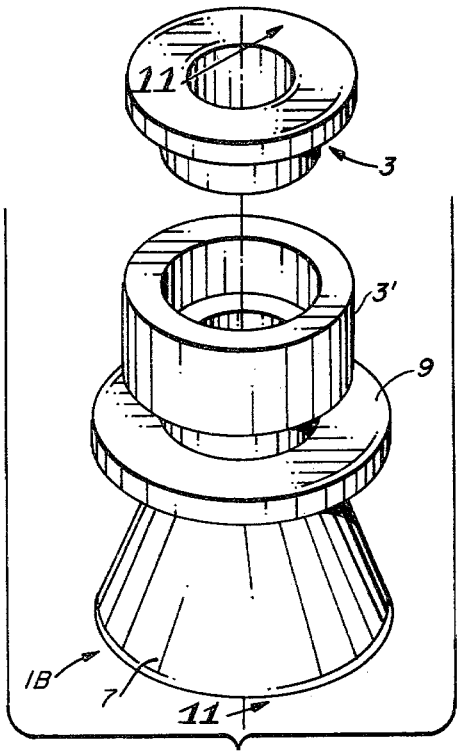
FIG. 10 is a perspective view of the variation of the bushing/seal assembly of FIG. 8.
Figure 11:
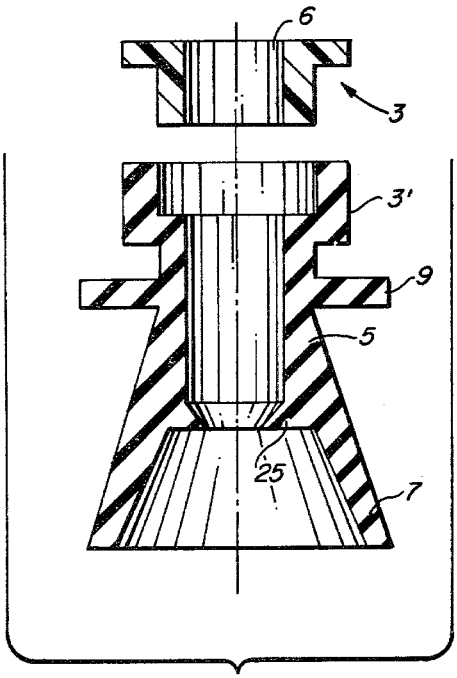
FIG. 11 is a sectional view taken along section line 11—11 of FIG. 10.

Another variation of the structure shown in the embodiments of FIGS. 6–9 is shown in the embodiment of the invention illustrated in FIGS. 10 and 11. This embodiment of the invention differs from that shown in FIGS. 6–9 only in the configuration of sphincter portion 25, which has a triangular shape similar to that shown in the embodiment of FIG. 1.

Figure 7:
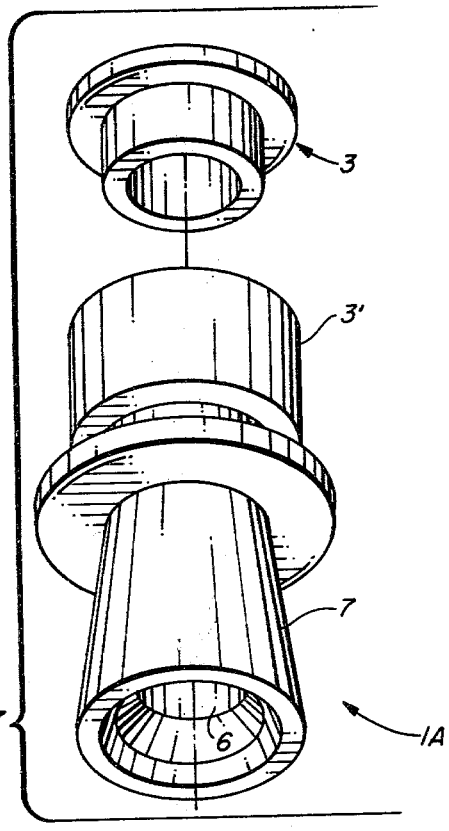
FIG. 7 is an alternate perspective view of the embodiment of the invention shown in FIG. 6.
Figure 8:
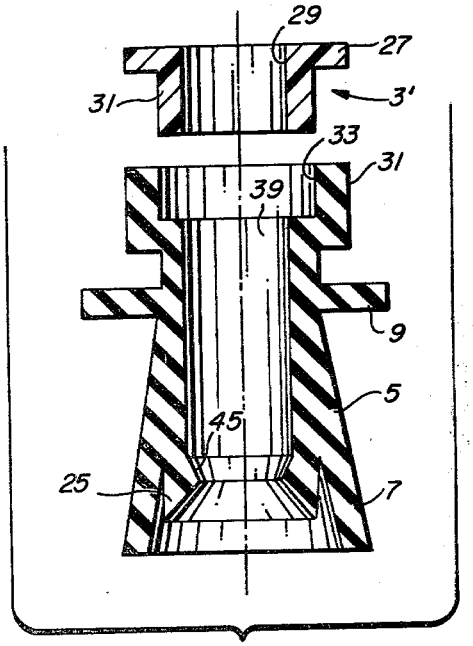
FIG. 8 is a sectional view taken along section line 8—8 of FIG. 6.
Figure 12:
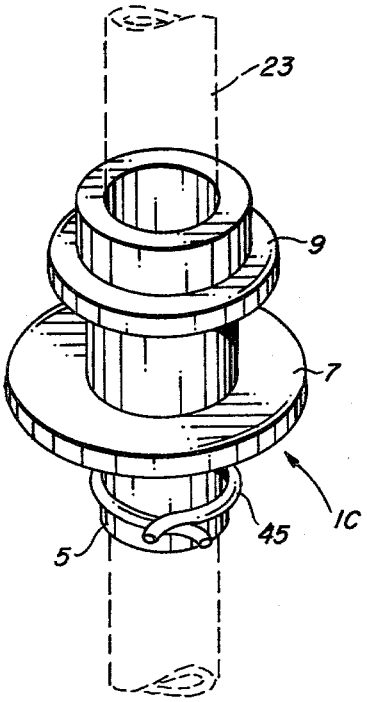
FIG. 12 is a perspective view illustrating another embodiment of the invention.
Figure 13:
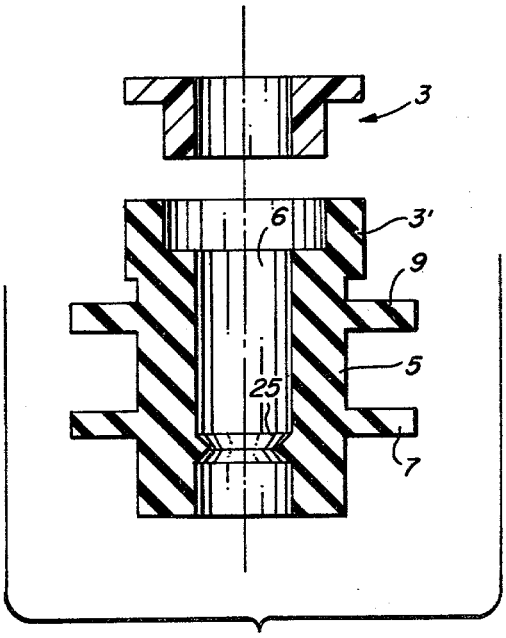
FIG. 13 is a partial sectional view of the embodiment of the invention shown in FIG. 12.

Yet another embodiment of the bushing/seal of the present invention is shown in FIGS. 12 and 13, which combines certain features of the embodiments of FIGS. 1 and 7. The stabilizing washer 3 and washer/receiving section 3′ of the embodiment of FIG. 6 utilized, while the skirt structure of the embodiment of FIG. 1 are utilized. A somewhat different symmetrical sphincter arrangement 25 having an isosceles triangular cross-section is utilized. As indicated in FIG. 12, a very effective sealing relationship between sphincter 25 and the stem of roof bolt 23 can be achieved by utilizing a spring clip 45 disposed around the outside of tubular body 5 over sphincter 25. In certain instances, if spring clip 45 is utilized it would be possible to obtain an airtight seal with respect to roof bolt 23 even if sphincter 25 is omitted.

While the invention has been described with reference to several particular embodiments thereof, those skilled in the art will be able to make various modifications to the disclosed embodiment of the invention without departing from the true spirit and scope thereof, as set forth in the appended claims.

I claim:

1. A bushing seal assembly for a mine roof bolt, said bushing seal assembly comprising in combination:

a. a tubular body, said tubular body having an upper end and a lower end and also having a hole extending from the upper end to the lower end for receiving the shaft of a mine roof bolt, said mine roof bolt extending through said hole;

b. seal means connected to said flexible body for producing an airtight seal between a shaft of said roof bolt and said flexible body;

c. flexible upper skirt means connected to said flexible body around the outside surface of said flexible body for sealably engaging an interior wall of a first mine roof bolt having a first diameter to prevent entry of moist mine air from a mine tunnel into a portion of the first mine roof bolt hole located on the opposite side of said bushing seal assembly from said mine tunnel;

d. flexible lower skirt means connected to said upper skirt means for sealably engaging an interior wall of a second mine roof bolt hole having a second diameter which is different than said first diameter to prevent entry of moist mine air from the mine tunnel into a portion of said second mine roof bolt hole located on the opposite side of said bushing seal assembly from said mine tunnel; and e. rigid stabilizing means disposed around said shaft of said mine roof bolt for engaging the wall of one of said first and second mine roof bolt holes in which said bushing seal assembly is to be installed to prevent said roof bolt shaft from moving close enough to said wall to prevent said first skirt and said second skirt from sealably engaging the wall of said one of said first and said second mine roof bolt holes.

2. The bushing seal assembly of claim 1 wherein said tubular body includes a plurality of lugs extending from the upper end thereof, said upper end including a flat surface which is perpendicular to an axis of said tubular body, and said rigid stabilizing means includes a flat metal washer through which said roof bolt shaft extends, said flat metal washer being disposed against said upper end of said tubular body, said flat metal washer having a plurality of lug receiving openings for receiving said plurality of lugs, respectively, said flat metal washer thereby being maintained perpendicular to said mine roof bolt.

3. The bushing seal assembly of claim 1 wherein said rigid stabilizing means includes a disk-shaped upper section for engaging said wall of said one of said first and second mine roof bolt holes and a sleeve-shaped lower section attached to said disk-shaped upper section for preventing tilting of said disk-shaped upper section relative to said roof bolt shaft, said tubular body including a cylindrical sleeve-receiving section into which said sleeve-shaped lower section snugly fits.

4. The bushing seal assembly of claim 1 wherein said upper skirt means is generally disk-shaped, said lower skirt means being located sufficiently far below said first skirt means to avoid overlapping of said lower skirt means by said upper skirt means when said upper skirt means is flexed due to said sealing engagement of said upper skirt means with said wall of said first mine roof bolt hole.

5. The bushing seal of claim 4 wherein said lower skirt means is also generally disk-shaped.

6. The bushing seal assembly of claim 1 wherein said tubular body extends sufficiently far below the connection thereof to said lower skirt means to allow said bushing seal to be pushed sufficiently far into said one of said first and second roof bolt holes by the lower portion of a roof bolt assembly including said mine roof bolt to ensure that either said first or second skirt means is positioned further into said one of said first and second roof bolt holes than any irregular portions of the wall at the mouth of said one of said first and second roof bolt holes.

7. The bushing seal assembly of claim 1 wherein said tubular body, said first and second skirt means and said seal means are integral and are composed of an elastomer.

8. The bushing seal assembly of claim 7 wherein said elastomer is neoprene.

9. The bushing seal assembly of claim 1 wherein said second diameter is greater than said first diameter.

10. The bushing assembly of claim 4 wherein said lower skirt means is generally frusto-conically shaped.

11. The bushing seal assembly of claim 10 wherein said second diameter is less than said first diameter.

12. The bushing seal assembly of claim 1 wherein said seal means includes flexible sphincter means circumferentially disposed around the wall of said hole, the diameter of said hole at said sphincter means being substantially less than the diameter of said roof bolt shaft to effect airtight sealing of said sphincter means against said roof bolt shaft.

13. The bushing seal assembly of claim 1 wherein said seal means includes clamping means disposed tightly around said tubular body for causing the wall of said hole to sealably engage said roof bolt shaft and produce an airtight seal therewith.

14. The bushing seal assembly of claim 10 wherein said seal means is disposed beneath the connection of said lower skirt means and is shaped to be squeezed between said roof bolt shaft and said lower skirt means when said lower skirt means is flexed due to engagement with a wall of a roof bolt hole, thereby increasing the integrity of the sealing of said seal means with said roof bolt shaft.

* * * * *

UNITED STATES PATENT AND TRADEMARK OFFICE

CERTIFICATE OF CORRECTION

PATENT NO. : 4,300,859

DATED : November 17, 1981

INVENTOR(S) : David C. Donan, Jr.

It is certified that error appears in the above—identified patent and that said Letters Patent is hereby corrected as shown below:

The title page should appear as shown on the attached sheet.

Signed and Sealed this

*Twenty-third* Day of *February 1982*

[SEAL]

*Attest:*

GERALD J. MOSSINGHOFF

*Attesting Officer*

*Commissioner of Patents and Trademarks*

United States Patent [19]

Donan, Jr.

[11] 4,300,859

[45] Nov. 17, 1981

[54] DUAL DIAMETER BUSHING/SEAL FOR MINE ROOF BOLT

[75] Inventor: David C. Donan, Jr., Manitou, Ky.

[73] Assignee: Waiamea Company, Inc., Manitou, Ky.

[21] Appl. No.: 192,061

[22] Filed: Sep. 29, 1980

[51] Int. Cl.[3] ..... E21D 20/00; E21D 21/00

[52] U.S. Cl. ..... 405/259; 277/208

[58] Field of Search ..... 405/259-261, 405/262; 277/208; 411/15-24, 28-34

[56] References Cited

U.S. PATENT DOCUMENTS

| | | | |
|---|---|---|---|
| 2,952,129 | 9/1960 | Dempsey | 405/261 |
| 3,057,408 | 10/1962 | Griffitts | 277/208 |
| 3,212,269 | 10/1965 | Olsen | 405/260 |
| 3,247,905 | 4/1966 | Baker | 277/208 X |
| 3,487,753 | 1/1970 | Read et al. | 277/208 X |
| 3,504,498 | 4/1970 | Triplett | 405/259 X |
| 4,103,498 | 8/1978 | Steinborn et al. | 405/259 X |

FOREIGN PATENT DOCUMENTS

| | | | |
|---|---|---|---|
| 2749068 | 5/1979 | Fed. Rep. of Germany | 405/261 |
| 569650 | 11/1957 | Italy | 277/208 |
| 89536 | 11/1958 | Netherlands | 277/208 |
| 2004967 | 4/1979 | United Kingdom | 405/260 |

*Primary Examiner*—Dennis L. Taylor

*Attorney, Agent, or Firm*—Cahill, Sutton & Thomas

[57] ABSTRACT

A bushing/seal assembly for providing an airtight seal between the shaft of a mine roof bolt and a roof bolt hole includes a body having first and second flexible skirts extending outwardly from the body, the diameter of the first skirt being less than the diameter of the second skirt in order to facilitate adequate sealing with both standard size and slightly overside roof bolt holes. A rigid stabilizing washer engages the flexible body, the roof bolt shaft and the wall of the roof bolt hole in order to prevent excessive tilting of the roof bolt assembly after anchoring thereof in the roof bolt hole.

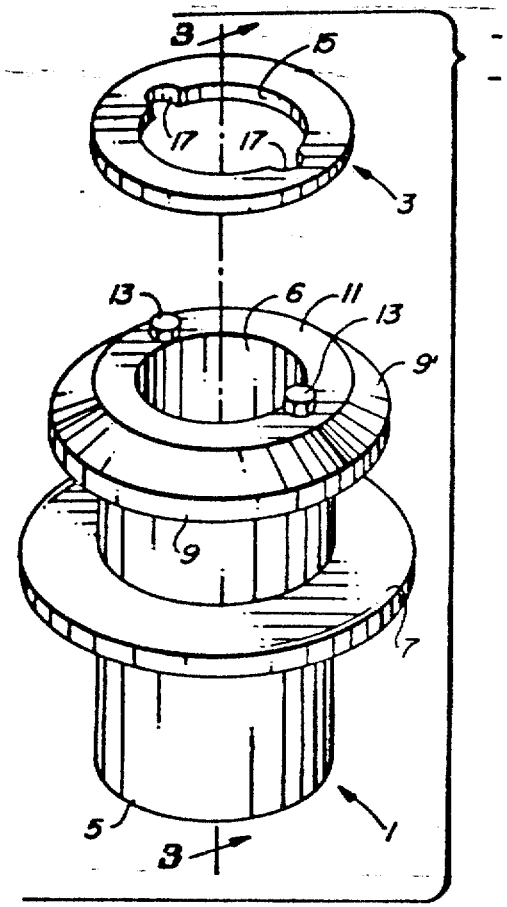

14 Claims, 13 Drawing Figures